US008919247B2

(12) United States Patent
Morgavi et al.

(10) Patent No.: US 8,919,247 B2
(45) Date of Patent: Dec. 30, 2014

(54) DEVICE AND METHOD FOR PRINTING BY TRANSFER ONTO A CYLINDRICAL PRINTING MEDIUM

(75) Inventors: Paul Morgavi, La Ciotat (FR); Philippe Sarra-Bournet, Aix-en-Provence (FR); Luc Vanon, Lentiol (FR)

(73) Assignees: Impika, Aubagne (FR); Boxal France SAS, Beaurepaire (FR)

( * ) Notice: Subject to any disclaimer, the term of this patent is extended or adjusted under 35 U.S.C. 154(b) by 933 days.

(21) Appl. No.: 12/440,919

(22) PCT Filed: Jul. 20, 2007

(86) PCT No.: PCT/FR2007/001251

§ 371 (c)(1),
(2), (4) Date: Aug. 3, 2009

(87) PCT Pub. No.: WO2008/031930

PCT Pub. Date: Mar. 20, 2008

(65) Prior Publication Data

US 2010/0031834 A1 Feb. 11, 2010

(30) Foreign Application Priority Data

Sep. 12, 2006 (FR) ..... 06 07955

(51) Int. Cl.

| | |
|---|---|
| ***B41F 17/20*** | (2006.01) |
| ***B41F 17/08*** | (2006.01) |
| ***B41M 5/025*** | (2006.01) |
| ***B41J 2/005*** | (2006.01) |
| ***B41J 3/407*** | (2006.01) |

(52) U.S. Cl.
CPC ..... *B41M 5/0256* (2013.01); *B41J 2/0057* (2013.01); *B41J 3/4073* (2013.01)
USPC ..... 101/38.1; 101/492; 347/4

(58) Field of Classification Search
USPC ..... 101/38.1, 492; 347/4
IPC ..... B41F 17/08,17/18, 17/22, 17/20
See application file for complete search history.

(56) References Cited

U.S. PATENT DOCUMENTS

| | | | |
|---|---|---|---|
| 5,389,958 | A | 2/1995 | Bui et al. |
| 5,618,338 | A | 4/1997 | Kurabayashi et al. |

(Continued)

FOREIGN PATENT DOCUMENTS

| | | |
|---|---|---|
| DE | 10 2004 031 185 | 1/2006 |
| DE | 10 2004 031 185 A1 | 1/2006 |

(Continued)

OTHER PUBLICATIONS

A. Colleu et al., The Inkjet Printing, Dec. 22, 2001, http://cerig.efpg.inpg.fr/memoire/1999/jet-d-encre-2.htm.

*Primary Examiner* — Leslie J Evanisko
(74) *Attorney, Agent, or Firm* — Blakely Sokoloff Taylor & Zafman

(57) ABSTRACT

The invention relates to a device for printing by transfer onto a print support (10) comprising at least one blanket (30) driven in a sequential relative movement past a magazine (50) conveying the print supports (10), in which device the blanket (30) has a surface area greater than that of the print support (10), the device further comprising digital printing means (20) which print by spraying ink onto this blanket (30) over a variable area equal to that of the print support (10).

25 Claims, 3 Drawing Sheets

(56) References Cited

U.S. PATENT DOCUMENTS

Figure 1:
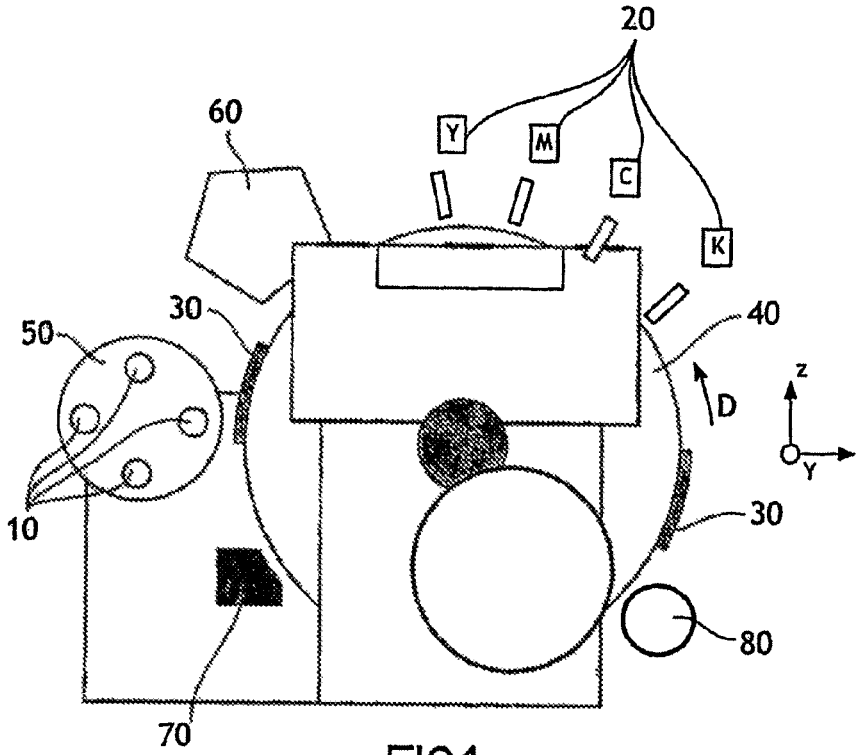

| | | | | |
|---|---|---|---|---|
| 5,931,166 | A * | 8/1999 | Weber et al. | 132/73 |
| 6,109,746 | A | 8/2000 | Jeanmaire et al. | |
| 6,276,266 | B1 * | 8/2001 | Dietz et al. | 101/41 |
| 6,920,822 | B2 | 7/2005 | Finan | |
| 2004/0173110 | A1 * | 9/2004 | Roesch et al. | 101/136 |
| 2005/0045053 | A1 * | 3/2005 | Finan | 101/38.1 |
| 2006/0152566 | A1 | 7/2006 | Taniuchi et al. | |
| 2008/0041250 | A1 * | 2/2008 | Clark et al. | 101/217 |
| 2010/0257819 | A1 * | 10/2010 | Schach | 53/411 |

FOREIGN PATENT DOCUMENTS

| | | | |
|---|---|---|---|
| EP | 1 053 882 | | 11/2000 |
| EP | 1 053 882 | A2 | 11/2000 |
| EP | 1 086 826 | | 3/2001 |
| EP | 1 919 711 | | 11/2010 |
| GB | 2376920 | A * | 12/2002 |
| JP | 61069487 | | 4/1986 |
| JP | 61-283599 | | 12/1986 |
| JP | 08174957 | A * | 7/1996 |
| JP | 8-207265 | | 8/1996 |
| JP | 11-291478 | | 10/1999 |
| JP | 2001-18362 | | 1/2001 |
| JP | 2002-86690 | | 3/2002 |
| JP | 2003-25707 | | 1/2003 |
| JP | 2005-186358 | | 7/2005 |
| JP | 2006-110831 | | 4/2006 |
| JP | 2006-167976 | | 6/2006 |
| WO | WO 03/103966 | | 12/2003 |
| WO | WO 03/103966 | A1 | 12/2003 |
| WO | WO 2004/113082 | | 12/2004 |
| WO | WO 2004/113082 | A1 | 12/2004 |
| WO | WO 2007/128781 | | 11/2007 |
| WO | WO 2008/031930 | | 3/2008 |

* cited by examiner

DEVICE AND METHOD FOR PRINTING BY TRANSFER ONTO A CYLINDRICAL PRINTING MEDIUM

This is a non-provisional application claiming the benefit of International application number PCT/FR2007/001251 filed Jul. 20, 2007.

This present invention relates to the general technical field of the printing of information, identical or different, from one impression to the next, onto a cylindrical, preferably metallic, printing medium. The printing medium can be an object to be decorated for example.

The present invention applies in particular to the field of printing techniques that employ the inkjet printing technique.

More particularly, the invention concerns the field of printing by transfer onto a cylindrical, metallic printing medium.

GENERAL PRESENTATION OF THE PRIOR ART

The printing or decoration of cylindrical metallic objects is generally based at present on different conventional printing methods such as flexography, offset (printing by a double-offset technique) or pad printing. These methods, based on the transfer of ink that has been deposited beforehand onto an offset blanket, are intended for the printing of constant patterns that are reproduced in large numbers (hundreds of thousands of copies).

The principle of these methods consists of using a plate engraved with the pattern to be reproduced. In a first stage, this plate is coated with ink. Then, in a second stage, the plate coated with ink is applied onto the offset blanket which gathers the ink onto its surface. In a third stage, the ink gathered onto the surface of the offset blanket is transferred onto the cylindrical printing medium by virtue of a calibrated pressure of the offset blanket onto the printing medium.

Although these technologies are very suitable for the printing of constant patterns in large numbers, they do not allow the printing of patterns that vary from one printing to the next, typically based on digital data.

The same problem arises in printing that employs a screen-printing technique.

Indeed, at each change of pattern, these technologies require that the plate engraved with the pattern to be reproduced, or the screen-printing plate, should be changed, and that the offset blanket should be cleaned.

The general aim of the invention is to propose a transfer printing method that can be used to overcome the drawbacks of the existing printing methods.

In particular, one objective of this present invention is to propose a printing method and an associated device than can be used for printing onto print media of cylindrical shape, that is simpler to implement than the existing methods.

PRESENTATION OF THE INVENTION

To this end, according to this present invention, there is provided a device for printing by transfer onto a cylindrical printing medium, the device including at least one offset blanket which is driven with a relatively sequential motion in front of a magazine bearing the printing media, the offset blanket having a surface that is greater than the surface of the printing medium, the device further including digital means for printing by projection of ink onto the offset blanket, onto a surface that is equal to that of the printing medium, so that the image covers the circumference of the lateral face of the cylindrical printing medium.

In the context of this present invention, "surface of the printing medium", refers to the surface to be printed of the printing medium.

The surface to be printed is located on the lateral face of the cylindrical printing medium. It can be either one or more portions of this lateral face, or the entirety of the lateral face.

In any event, the surface to be printed is continuous, meaning that the printed image covers all the circumference of the cylindrical printing medium.

The fact that the device includes the following in combination:

- at least one offset blanket with a surface that is greater than that of the printing medium, and
- digital means for printing, by projection of ink onto the offset blanket, onto the surface that is equal to that of the printing medium, allows:
- to print printing media of various dimensions, with patterns of various shapes and dimensions, without having to change the offset blanket,
- to increase the quality of the printing, firstly by correctly closing the printed image onto the cylindrical printing medium, and secondly by avoiding overlaps.

In a variant, the offset blanket is a continuous single strip in motion.

In another variant, the (or each) offset blanket is a sheet.

In these two variants, the offset blanket can be fixed to a carrousel or a roller, such as a rubber-covered roller, for example. The offset blanket can also be placed around at least one motor-driven flat pulley.

Optionally, the device also includes means that are designed to measure the amplitude of the printing medium.

The device also includes processing means that are designed to adapt the dimensions of the image applied onto the offset blanket in accordance with the circumference of the printing medium.

The means for printing by ink projection can include one or a plurality of printing heads positioned so that the distance separating a printing head from the offset blanket is constant. This allows improving the quality of the printing, the distance of drop projection onto the offset blanket being constant.

In one embodiment, the device also includes means for fixing the ink by the application of a treatment to the ink.

In this case, the means for fixing the ink are designed to fix the ink partially onto the offset blanket. This allows improving the transfer of the image from the offset blanket onto the printing medium, and thus improving the quality of the printing. In one embodiment, the fixing means can also allow fixing of the ink onto the printing medium.

When the printing medium and the offset blanket are in contact, the printing medium can be driven in rotation:

- either by the offset blanket under the action of friction forces between the printing medium and the offset blanket,
- or by one element of the transportation means, said element being used to set the medium into rotation when the medium and the offset blanket are in contact.

The movement of the offset blanket can advantageously be a rotary movement.

According to a non-limiting variant developed by the IMPIKA company, the device can include means for the application of a liquid reception layer onto the offset blanket. The ink application means can allow deposition of the liquid reception layer before or after the application of the image by the digital printing means. The liquid reception layer and the ink can be of different natures to allow a targeted fixing of the liquid reception layer or of the inks by the fixing means.

The invention also concerns a method for transfer printing onto a cylindrical printing medium including:

the application of an image onto an offset blanket that is driven with a relatively sequential motion in front of a magazine bearing printing media, the transfer of the image onto the cylindrical printing medium by contact of the offset blanket with said medium, in which the surface of the offset blanket is greater than the surface of the cylindrical printing medium, the image being applied onto the offset blanket by the projection of ink using digital printing means onto a variable surface that is equal to the surface of the cylindrical printing medium so that the image covers the circumference of the lateral face of the cylindrical printing medium.

In a variant of the method, the offset blanket is a continuous moving strip.

In another variant of the method, the offset blanket is a sheet.

In any event, the offset blanket can be attached to a carrousel or a roller (a rubber-covered roller, for example), or be placed around at least one motor-driven flat pulley.

Optionally, the method also includes a step of measuring the circumference of the cylindrical printing medium.

The method can also include a step of adapting the dimensions of the image applied onto the offset blanket in accordance with the circumference of the printing medium.

In a variant, the method includes a step of fixing the ink by the application of a treatment to the ink.

This fixing step can be carried out, at least partially, onto the offset blanket.

The invention also concerns an offset blanket for printing by transfer onto a cylindrical printing medium, with the surface of the offset blanket being greater than the surface of the cylindrical printing medium.

The invention also concerns a cylindrical printing medium obtained by the method described above.

PRESENTATION OF THE FIGURES

Figure 2:
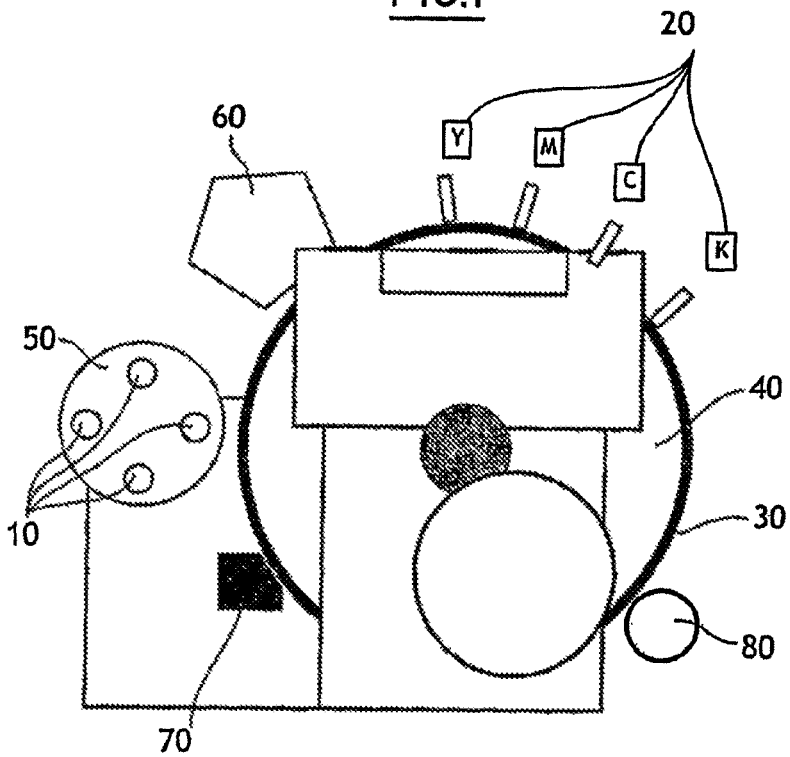
Figure 3:
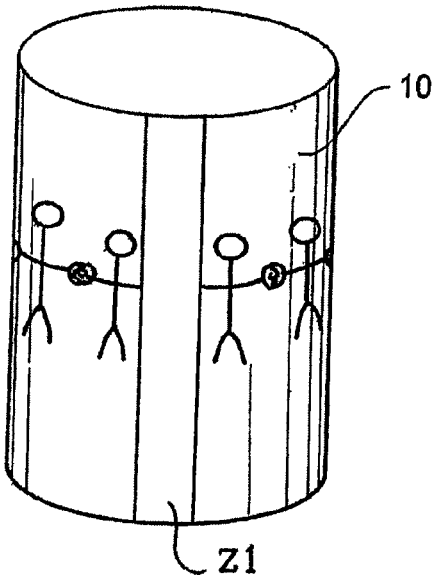
Figure 4:
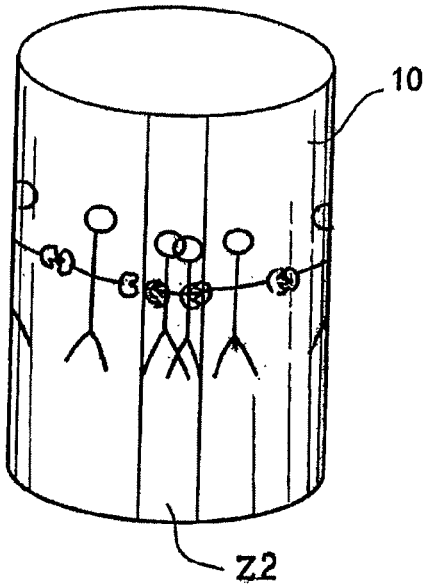
Figure 5:
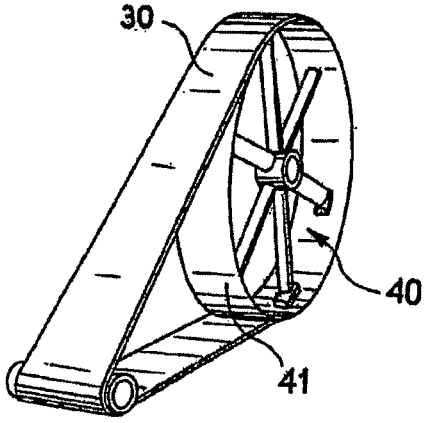
Figure 6:
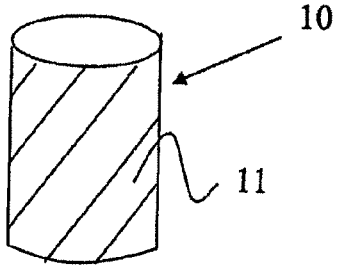
Figure 7:
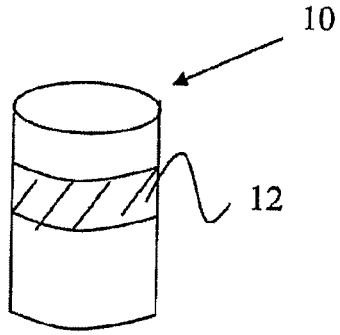
Figure 8:
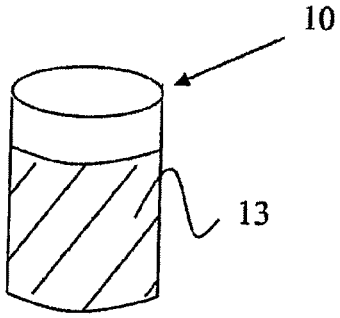
Figure 9:
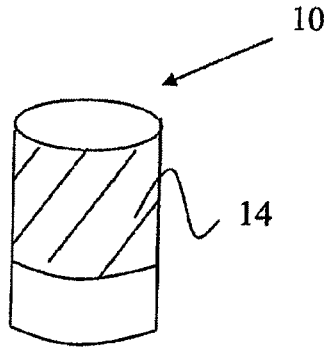
Figure 10:
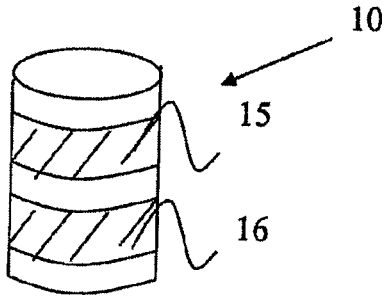

Other characteristics, aims and advantages of the present invention will become more clearly apparent from the following description, which is purely illustrative and non limiting, and which should be read with reference to the appended drawings on which:

FIGS. 1 and 2 illustrate different embodiments of the device of the invention, FIGS. 3 and 4 illustrate examples of printing media, FIG. 5 illustrates one embodiment of an offset blanket and a conveyor, FIGS. 6 to 10 illustrate printing examples created on the printing media.

DESCRIPTION OF THE INVENTION

Referring to FIG. 1, one embodiment of the device according to the invention is illustrated.

The device of the invention is a device for printing by transfer onto a printing medium. It is particularly designed for the printing of a cylindrical printing medium, preferably metallic. For example, the printing medium 10 can be a receptacle such as an aerosol or a can.

In the embodiment illustrated in FIG. 1, the printing device includes means for printing by projection of ink 20, at least one offset blanket 30, a conveyor 40, and means for transportation 50.

The printing means 20 allow the application, by the projection of ink onto the offset blanket 30, of the image to be reproduced onto the cylindrical printing medium 10.

The image to be reproduced can be a pattern and/or text. This image can be monochrome or in colour.

In the embodiment illustrated in FIG. 1, the printing means 20 include four printing heads (Y, M, C, K) that are designed to project inks of different colour. Thus, the printing means 20 illustrated in FIG. 1 allow the application of a colour or monochrome image onto the offset blanket 30.

The printing means 20 can include a multiplicity of printing heads (Y, M, C, K) that are designed to project inks. This allows increasing the speed of application of the image onto the offset blanket 30.

In certain embodiments, the printing means 20 can also include a single printing head in the case where the device of the invention is dedicated only to the printing of a monochrome image onto the printing medium 10 (or a multiplicity of printing heads that are each designed to project ink of a different colour).

Care will have been taken to process the image applied onto the offset blanket 30 (negative) so that it appears in the correct orientation after transfer onto the cylindrical printing medium 10 (mirror effect).

The use of digital printing means 20 result in a high degree of flexibility regarding the application of the image onto the offset blanket 30. In particular, the use of digital printing means 20 results in less expensive printing since it is possible to customise the printing media without having to change the screen-printing plates or slides at each change of image, in contrary to techniques such as offset or pad printing, for example. Moreover, the use of digital printing means allows the application of an image onto a variable surface.

The application of ink can employ different application techniques according to the size of the printing medium 10 to be printed.

In one embodiment, the application technique used is a one-pass application technique.

In this case, the offset blanket 30 passes one time only under the printing heads (Y, M, C, K). The offset blanket 30 is placed on the conveyor 40, for example, with a portion of the conveyor 40 being positioned below the printing heads.

The conveyor moves in a direction of motion (D) such that the surface of the offset blanket 30 intended to receive the image to be transferred passes under the printing heads (Y, M, C, K).

The printing heads (Y, M, C, K) project ink (or inks) onto the surface of the offset blanket 30, with the image to be transferred onto the printing medium 10 being applied onto the surface of the offset blanket 30.

In another embodiment, the application technique used is a multi-pass application technique.

In this case, the offset blanket 30 has to pass several times under the printing heads (Y, M, C, K) so that the image is applied completely onto the surface of the offset blanket 30.

The offset blanket 30 is an elastomer material intended for transferring the ink onto the printing medium 10.

In the embodiment illustrated in FIG. 1, the device includes two offset blankets 30. This allows us to increase the printing rate of the printing media 10. Naturally, the device can include more than two offset blankets.

Each offset blanket 30 is composed of a layer of material placed onto the conveyor 40.

As illustrated in FIG. 1, each offset blanket 30 has a surface that is greater than the surface of the cylindrical printing medium 10.

Although each offset blanket 30 has a surface that is greater than that of the printing medium 10, the surface of the image applied onto the offset blanket 30 by the digital printing means 20 is equal to that of the cylindrical printing medium 10.

This combination of at least one offset blanket with a surface greater than that of the printing medium, and digital printing means 20 that can be used to apply an image onto the offset blanket 30, onto a surface equal to that of the printing medium 10, has many advantages.

It allows correctly closing the image transferred onto the cylindrical printing medium 10 on one hand (meaning that the image transferred onto the printing medium is uninterrupted). Thus, as illustrated in FIG. 3 for a cylindrical printing medium, this combination allows avoiding that a zone Z1 of the medium is not printed.

It allows avoiding any risk of overlap of the image transferred onto the cylindrical printing medium on the other hand (i.e. to prevent one portion of the image overlapping onto another portion of the image). Thus, and as illustrated in FIG. 4 for a cylindrical printing medium, this combination allows preventing two portions of the image from overlapping in a given zone Z2.

This is not possible with an offset technology.

The device of the invention allows the printing of a cylindrical medium over the whole circumference of its lateral face. As illustrated in FIGS. 6 to 10, the association of digital printing means with an offset blanket whose dimensions are greater than those of the surface to be printed, allows either:

- to print an image 11 onto the entirety of the lateral face of the printing medium 10, or
- to print an image 12, 13, 14 onto a portion of the lateral face of the printing medium 10, or
- to print several images 15, 16 onto different portions of the lateral face of the printing medium 10.

Thus, the combination of at least one offset blanket, with a surface that is greater than that of the printing medium (and in particular having a face for which one dimension is greater than the circumference of the printing medium), and digital printing means 20 that can be used to apply an image onto the offset blanket 30, onto of surface that is equal to that of the printing medium 10 (and in particular onto a surface of which one of the dimensions is equal to the circumference of the medium), allows printing of the printing medium over all of its circumference by correctly closing the transferred image and by avoiding overlap problems.

Naturally, pieces of the printed image can be transparent. In this case, a transparent layer is applied onto the medium, with the remaining image then being continuous.

Moreover, this combination allows achieving printing of better quality than with an offset-type technology.

In fact, with the offset technology, application of the image onto the offset blanket requires a given attack angle of the offset blanket in order to generate a friction between the offset blanket and the offset roller. At the beginning of such friction, application of the image onto the offset blanket results in a crushing action and therefore in a reduced printing quality.

Finally, this combination allows printing onto cylindrical print media 10 of various dimensions without having to change the offset blanket 30.

The conveyor 40 is a carrousel, and is used to support the offset blanket. Nevertheless, the conveyor 40 can be of any other type known to those skilled in the art.

The transportation means 50 (i.e. the magazine bearing the printing media) are used to carry the cylindrical printing media 10. These transportation means 50 are placed downstream of the digital printing means 20.

The transportation means 50 can be of any type known to those skilled in the art.

The transportation means 50 are arranged so as to allow the bringing into contact of the surface to be printed of the cylindrical printing 10 with the offset blanket 30 for transfer of the image from the offset blanket onto the printing medium 10. The movement of the transportation means 50 is matched to the cylindrical shape of the printing medium.

In the embodiment illustrated in FIG. 1, the transportation means 50 include four mandrels lying along axes that are parallel to the axis of rotation of the conveyor 40. Each mandrel is designed to receive a cylindrical printing medium 10, such as a can or a flask, for example. Naturally, the transportation means 50 can include more than four mandrels. The transportation means can include other means than can be used to drive the printing medium into motion when the latter is being printed, meaning when it is in contact with the offset blanket. More precisely, the transportation means can include an element (a motor, for example) than can be used to rotate the printing medium when the latter is in contact with the offset blanket.

Optionally, the device can also include fixing means 60, a varnishing block 70 and cleaning means 80.

The fixing means 60 are used to dry the image applied onto the offset blanket 30, by heating, for example, or by reticulation (curing, with the application of infrared or ultraviolet radiation). These fixing means are placed downstream of the digital printing means 20, and upstream of the transportation means 50 in direction D. The fixing means 60 can be of any type known to those skilled in the art.

The varnishing block 70 is a system that can be used to deposit a layer of varnish onto the offset blanket 30 once the transfer of the image onto the printing medium has been completed. This layer of varnish acts as protection for the image transferred onto the printing medium.

This varnishing block 70 is of any type known to those skilled in the art.

The varnishing block 70 can be placed upstream or downstream of the transportation means 50 in direction D.

The cleaning means 80 are used for cleaning the surface of the offset blanket 30. These cleaning means 80 can be placed upstream or downstream of the transportation means 50 in direction D of movement of the conveyor 40.

The operating principle of the device illustrated in FIG. 1 is as follows.

The conveyor 40 moves in rotation in direction D.

The offset blanket 30 placed on the conveyor passes under the printing heads (Y, M, C, K) of the digital printing means 20. The printing heads project ink onto the offset blanket 30 so as to apply the image onto the latter. According to the application techniques used (one-pass or multi-pass), the offset blanket 30 passes one or more times under the printing heads, for application of the image.

Once the image has been applied, the offset blanket 30 passes under the fixing means 60 which partially dry the image applied onto the offset blanket 30.

In the case of a multi-pass application technique, the fixing means can partially dry the ink applied onto the offset blanket after each passage.

The offset blanket 30 passes under the transportation means 50, which move so that cylindrical printing medium 10 comes into contact with the offset blanket 30.

When the offset blanket and the printing medium are in contact, the offset blanket and the printing medium can be in relative motion to each other. More specifically, when the offset blanket and the printing medium are in contact, the offset blanket is in motion in relation to the printing medium, and the printing medium is in motion in relation to the offset blanket. In one embodiment, the offset blanket and the printing medium are both in rotation when they are in contact. This allows printing of the offset blanket over its entire circumference in a continuous manner.

Advantageously, when the offset blanket and the printing medium are in contact, the printing medium can be driven in rotation:

- under the action of the offset blanket by virtue of the friction forces exerted by the moving offset blanket onto the printing medium,
- under the action of an element placed on the transportation means and that can be used to rotate the printing medium.

The image is transferred onto the cylindrical printing medium 10.

Optionally, the offset blanket 30 passes in front of the varnishing block 70 which applies a layer of varnish onto the offset blanket 30.

The conveyor 40 moves so that the offset blanket 30 again passes under the transportation means 50. In the case of a cylindrical conveyor 40, the offset blanket undertakes a second tour around the axis of the conveyor.

The transportation means 50 perform a movement toward the offset blanket 30 so that the cylindrical printing medium 10 onto which the image has been transferred comes into contact with the offset blanket 30. The layer of varnish is transferred onto the cylindrical printing medium 10.

The conveyor 40 moves the offset blanket 30 so that it passes under the cleaning means 80, which clean the surface on the offset blanket 30.

Referring to FIG. 2, another embodiment of the device according to the invention is illustrated.

The differences between the embodiments illustrated in FIGS. 1 and 2 concern the offset blanket 30.

In the embodiment illustrated in FIG. 2, the offset blanket 30 is a single continuous strip.

In the context of this present invention, "continuous" refers to an offset blanket whose face, intended to receive the inks to be printed, is uninterrupted in at least one direction. In other words, a "continuous" offset blanket is an offset blanket that is closed onto itself.

Other than the advantages described previously in the case of an offset blanket whose surface is greater than that of the printing medium, the combination of digital printing means with a single continuous offset blanket 30 allows increasing the printing rate by optimising the use of the circumference of the conveyor 40.

In fact, the printing rate is given by the following formula:

$$\text{CADENCE} = \frac{Nb._\text{of_blankets_} \times \text{speed_of_motion}}{\text{conveyor_perimeter}}$$

where:

CADENCE: is the printing rate,

Nb. of blankets: is the number of offset blankets on the conveyor, speed of motion: is the speed of travel of the offset blankets, which is currently limited by the inkjet printing speed (24 m/min), conveyor perimeter: is the perimeter of the conveyor in the case of a conveyor of the carrousel type.

Thus, by virtue of the processing means of the device (which are not shown), the fact that the device includes a continuous single offset blanket allows determining the maximum number of images that can probably be applied onto the continuous offset blanket 30, depending on the surface of the cylindrical printing medium.

This allows limiting the zones of the conveyor 40 that are not used for printing of the cylindrical printing media 10 and thus this allows optimising the printing rate according to the dimensions of the cylindrical printing medium.

In the embodiment illustrated in FIG. 1, the offset blanket 30 is composed of a sheet of material placed on one face of the conveyor 40. In the embodiment illustrated in FIG. 2, the offset blanket is composed of a continuous strip placed on the conveyor.

Nevertheless, the invention is not limited to these types of offset blankets. Indeed, in another embodiment, the offset blanket 30 is a rubber roller.

FIG. 5 illustrates another embodiment of the offset blanket 30 and of the conveyor 40.

In this embodiment, the conveyor 40 is composed of a motor-driven flat pulley that includes a flat rim 41 around which is placed the continuous offset blanket 30 in the form of a strip.

The device, according to the invention, can also include means for measuring the circumference of the cylindrical printing medium, in order that the processing means adjust, with precision, the dimensions of the image in relation to those of the surface to be printed.

This allows taking into account the tolerance (acceptable variation in the dimensions of the printing media) on this printing medium, with the amplitude of the printing media able to vary from one printing medium to the next.

According to a non-limiting implementation variant developed by the IMPIKA company, the device can include means for the application of a liquid reception layer onto the offset blanket 30.

The means for applying the liquid reception layer can be application means by contact (in particular by offset), application means by spraying under pressure (spray technology), or application means by the projection of ink (inkjet technology).

The use of application means by projection of ink for depositing the liquid reception layer allows a more effective control of the quantity of liquid projected onto the offset blanket 30, and thus a more effective control of the thickness of the liquid reception layer so as to optimise the quality of the final printing.

The thickness of the liquid reception layer is typically, but not in any limiting manner, ranged between 2 and 80 μm. It should be noted that the thickness of the liquid reception layer is preferably greater than the diameter of the ink drops applied by the digital printing means.

Application of the image onto the offset blanket can be effected before or after deposition of the liquid reception layer.

The liquid reception layer is used to facilitate the transfer of the image onto the cylindrical printing medium 10.

According to the physical properties of the liquid reception layer, when the ink is projected on the liquid reception layer applied previously onto the offset blanket 30, the ink drops projected on the face of the offset blanket will either:

- remain on the top of the liquid reception layer,
- or be trapped in the liquid reception layer.

When the liquid reception layer is designed to capture the ink drops projected onto the face of the offset blanket, this liquid reception layer prevents two different drops from mixing.

The presence of means for the application of a liquid reception layer has many advantages, in particular when the direct printing onto the cylindrical printing medium is impossible for mechanical or other reasons (it is impossible to place the printing device sufficiently close to the printing medium, the printing medium is not flat, etc.).

According to one non-limiting but useful implementation of this present invention, the liquid reception layer and the ink are of different chemical natures so that their fixing or drying can be effected by means of different respective processes. Thus, the fixing or drying of one does not affect the other.

In particular one can arrange to fix the ink before fixing the liquid reception layer. In this case, the fixing of the ink is effected in a liquid reception layer that is still in the liquid state. This allows controlling a certain diffusion of the ink into the liquid reception layer. In particular, this results in good final resolution of the printing, good colour rendering and constant printing over time.

In a variant, however, and in particular according to the print rendering sought, it is possible to envisage fixing the ink after the liquid reception layer.

In the different embodiments of the device, the conveyor is cylindrical, with the transportation means 50 and the conveyor each being mobile in rotation. Nevertheless, it is possible to envisage a flat conveyor and transportation means moving in front of it.

The invention claimed is:

1. Device enabling printing by transfer of an image onto a plurality of cylindrical printing mediums where a circumference of at least a first of the plurality of cylindrical printing mediums varies from a circumference of a second of the plurality of cylindrical printing mediums, and where each of the plurality of cylindrical printing mediums has a lateral face, the device comprising:

a magazine which bears the plurality of cylindrical printing mediums;

at least one offset blanket which is driven adjacent the magazine bearing the plurality of cylindrical printing mediums;

a processor which adjusts dimensions of an image to be applied onto the at least one offset blanket to correspond with the circumference of the respective first and second cylindrical printing mediums of the plurality of cylindrical printing mediums; and at least one printing head which applies the adjusted images by projection of ink onto the at least one offset blanket;

wherein each adjusted image applied by the at least one printing head onto the at least one offset blanket is transferred from the at least one offset blanket onto the respective cylindrical printing medium by contact of the at least one offset blanket with said respective cylindrical medium, the adjusted image transferred from the at least one offset blanket has a leading end and a trailing end and is applied on at least a portion of the lateral face of the respective cylindrical printing medium, wherein each adjusted image transferred from the at least one offset blanket onto the respective cylindrical printing medium has dimensions that vary in accordance with the circumference of the respective cylindrical printing medium so that the adjusted image transferred from the at least one offset blanket onto the respective cylindrical printing medium covers the entire circumference of at least a portion of the lateral face of the respective cylindrical printing medium without one portion of the image transferred overlapping onto another portion of the adjusted image transferred onto the respective cylindrical printing medium and without gaps forming between the leading and trailing ends of the adjusted image transferred onto the respective cylindrical printing medium, thereby enabling the adjusted image transferred to be uninterrupted at the leading and trailing ends about the entire perimeter of at least a portion of the respective cylindrical printing medium and without image interference caused by layering of the leading and trailing ends.

2. Device according to claim 1, wherein the at least one offset blanket is a continuous single strip.

3. Device according to claim 1, wherein the at least one offset blanket is a sheet.

4. Device according to claim 1, wherein the at least one offset blanket is fixed to a carrousel or a rubber roller.

5. Device according to claim 1, wherein the at least one offset blanket is placed around at least one motor-driven flat pulley.

6. Device according to claim 1, wherein the device further comprises means for measuring the circumference of the respective cylindrical printing medium.

7. Device according to claim 6, wherein the device is configured to fit the dimensions of the image applied onto the at least one offset blanket in accordance with the measured circumference of the respective cylindrical printing medium.

8. Device according to claim 1, wherein the at least one printing head comprises a multiplicity of printing heads (Y, M, C, K) that are positioned so that the distance separating each printing head from the at least one offset blanket is constant.

9. Device according to claim 1, wherein the device further comprises means for fixing the ink by the application of a treatment to the ink.

10. Device according to claim 9, wherein the means for fixing the ink are designed to fix the ink partially onto the at least one offset blanket.

11. Device according to claim 1, wherein the cylindrical printing medium of one of the plurality of cylindrical printing mediums is driven in rotation when said cylindrical printing medium and the at least one offset blanket are in contact.

12. Device according to claim 11, wherein the cylindrical printing medium of one of the plurality of cylindrical printing mediums is driven in rotation by the at least one offset blanket when said cylindrical printing medium and offset blanket are in contact.

13. Device according to claim 11, wherein the cylindrical printing medium of one of the plurality of cylindrical printing mediums is driven in rotation by an element of the magazine bearing the plurality of cylindrical printing mediums said element being used to set the medium into rotation when said medium and the offset blanket are in contact.

14. Device according to claim 1, wherein the movement of the at least one offset blanket is a rotary movement.

15. Device according to claim 1, wherein the at least one offset blanket is driven with a relatively sequential motion in front of the magazine bearing the plurality of cylindrical printing mediums.

16. Method enabling printing by transfer of an image onto a plurality of cylindrical mediums where a circumference of at least a first of the plurality of cylindrical printing mediums varies from a circumference of a second of the plurality of cylindrical printing mediums, and where each of the plurality of cylindrical printing mediums has a lateral face, the method comprising:

adjusting dimensions of an image to be applied onto the at least one offset blanket to correspond with the circumference of the respective first and second cylindrical printing mediums of the plurality of cylindrical printing mediums, applying each adjusted image onto at least one offset blanket that is driven adjacent a magazine bearing the plurality of cylindrical printing mediums by projection of ink using at least one printing head, and transferring each adjusted image on the at least one offset blanket onto the respective cylindrical printing medium by contact of the at least one offset blanket with said respective cylindrical printing medium, wherein each adjusted image transferred from the at least one offset blanket has a leading end and a trailing end and is applied on at least a portion of the lateral face of the respective cylindrical printing medium, and wherein each adjusted image transferred from the at least one offset blanket having dimensions that vary in accordance with the circumference of the respective cylindrical printing medium so that the adjusted image transferred from the at least one offset blanket onto the respective cylindrical printing medium covers the entire circumference of at least a portion of the lateral face of the respective cylindrical printing medium without one portion of the adjusted image transferred overlapping onto another portion of the adjusted image transferred onto the respective cylindrical printing medium and without gaps forming between the leading and trailing ends of the adjusted image transferred onto the respective cylindrical printing medium, thereby enabling the adjusted image transferred to be uninterrupted at the leading and trailing ends about the entire perimeter of at least a portion of the respective cylindrical printing medium and without image interference caused by layering of the leading and trailing ends.

17. Method according to claim 16, further comprising measuring the circumference of the cylindrical printing medium of one of the plurality of cylindrical printing mediums.

18. Method according to claim 17, further comprising fitting the dimensions of the image applied onto the at least one offset blanket in accordance with the measured circumference of the cylindrical printing medium.

19. Method according to claim 16, wherein said image applied onto the at least one offset blanket is applied by projection of ink using a multiplicity of printing heads (Y, M, C, K).

20. Method according to claim 19, further comprising separating the multiplicity of printing heads (Y, M, C, K) a constant distance from the at least one offset blanket.

21. Method according to claim 16, further comprising fixing the ink by the application of a treatment to the ink.

22. Method according to claim 21, wherein said fixing fixes the ink partially onto the at least one offset blanket.

23. Method according to claim 16, further comprising driving the cylindrical printing medium of one of the plurality of cylindrical printing mediums in rotation when said cylindrical printing medium and the at least one offset blanket are in contact.

24. Method according to claim 16, further comprising driving the cylindrical printing medium of one of the plurality of cylindrical printing mediums in rotation by the at least one offset blanket when said cylindrical printing medium and offset blanket are in contact.

25. Method according to claim 16, wherein said application of the image onto at least one offset blanket is driven with a relatively sequential motion in front of the magazine bearing the plurality of cylindrical printing mediums.

* * * * *